US006631927B1

(12) United States Patent
Vold

(10) Patent No.: US 6,631,927 B1
(45) Date of Patent: Oct. 14, 2003

(54) SKI POLE HANDLE

(75) Inventor: Per Erik Vold, Lillehammer (NO)

(73) Assignee: Swix Sport (NO)

( * ) Notice: Subject to any disclaimer, the term of this patent is extended or adjusted under 35 U.S.C. 154(b) by 0 days.

(21) Appl. No.: 09/868,649

(22) PCT Filed: Nov. 6, 2000

(86) PCT No.: PCT/NO00/00370

§ 371 (c)(1),
(2), (4) Date: Sep. 28, 2001

(87) PCT Pub. No.: WO01/34255

PCT Pub. Date: May 17, 2001

(30) Foreign Application Priority Data

Nov. 12, 1999 (NO) ..... 19995570

(51) Int. Cl.[7] ..... A63C 11/22; A44B 11/10

(52) U.S. Cl. ..... 280/821; 24/458; 24/265 R

(58) Field of Search ..... 280/821, 822, 280/823, 819; 135/76; 24/458, 265 R, 265 EC, 129 R, 130; 16/111.1, 110.1

(56) References Cited

U.S. PATENT DOCUMENTS

| | | | | | |
|---|---|---|---|---|---|
| 3,560,014 | A | * | 2/1971 | Bruckl | 280/821 |
| 4,005,872 | A | | 2/1977 | Rischert et al. | |
| 4,130,293 | A | * | 12/1978 | Hinterreiter | 280/821 |
| 4,288,100 | A | * | 9/1981 | Aho | 280/821 |
| 4,288,101 | A | * | 9/1981 | Aho | 280/821 |
| 6,139,060 | A | * | 10/2000 | Lenhart | 280/821 |
| 6,264,242 | B1 | * | 7/2001 | Lenhart | 280/821 |
| 6,311,370 | B1 | * | 11/2001 | Blin | 280/821 |
| 6,386,588 | B1 | * | 5/2002 | Young et al. | 280/821 |
| 6,439,610 | B1 | * | 8/2002 | Pronzati | 280/821 |

FOREIGN PATENT DOCUMENTS

| | | | | |
|---|---|---|---|---|
| FR | 2 792 539 A1 | * | 4/1999 | 280/821 |
| NO | 159769 | | 10/1983 | |
| SE | 338530 | | 9/1971 | |
| SE | 430216 | | 10/1983 | |
| WO | WO-94/05384 | * | 3/1994 | 280/821 |

* cited by examiner

*Primary Examiner*—Brian L. Johnson
*Assistant Examiner*—Jeffrey J. Restifo
(74) *Attorney, Agent, or Firm*—Bacon & Thomas, PLLC

(57) ABSTRACT

A ski pole handle with a possibility of adjusting the effective length of a strap (3) fastened to the handle (1), said handle (1) having in its upper portion a throughgoing cavity (9) through which the strap (3) is threaded, and an element (12) is adapted to be pressed down into the cavity (9) in order to clamp the strap (3) against the walls of a downwardly tapering portion of the cavity (9). The element (12) is situated on a control knob (4) which is mounted at the top of the handle (1) and which can be pushed down and raised relatively to the handle (1), for fastening and releasing the strap (3), respectively, said knob (4) having a throughgoing aperture or apertures (8) for the strap (3).

8 Claims, 3 Drawing Sheets

SKI POLE HANDLE

FIELD OF THE INVENTION

The present invention relates to a ski pole handle with a possibility of adjusting the effective length of a strap fastened to the handle, said handle having in its upper portion a cavity through which the strap is threaded, and an element is adapted to be pressed down into the cavity in order to clamp the strap against the walls of a downwardly tapering portion of the cavity.

"Down" and "downwardly" means a direction relatively to a pole situated vertically and having the handle at the top.

PRIOR ART

It is known to lock such a strap by use of a separate wedge which is pushed down into a cavity from above. In order to disengage the wedge the strap can be pulled upwardly, whereby the wedge follows it and the clamping action ceases, and the strap can be adjusted. NO Acceptance Print No. 148439 shows an example of use of such a wedge, where the wedge is fastened to an end of the strap, whereby the strap is used to pull the wedge loose for adjustment. It is also known to equip the wedge with a pulling flap or loop, in order to facilitate pulling out the wedge when adjustment is to be performed.

Moreover, from NO Acceptance Print 145068 it is known a similar principle, where the wedge is substituted by a buckle which is hinged in the cavity and clamps the strap by being pivoted into the cavity.

CH Patent No. 596859 shows a pole handle with a strap adapted to disengage when subjected to a strong snatch away from the pole in the longitudinal direction of the pole, as when the disc of the pole gets stuck or the skier falls, in order to prevent damage. One end of the strap has a hole and is hooked onto a small pin at the top of the handle, and the other end of the strap is equipped with a control knob which is fastened to the top of the handle by use of a snap connection. Because the first mentioned end of the strap has a plurality of holes for the pin the effective length of the strap can be adjusted. The strap is not threaded through any cavity in the handle where the strap can be fastened. The end of the strap hooked onto the pin is inserted through a narrow opening in the uppermost of the handle, in order to increase the resistance against detachment during normal use.

SUMMARY OF THE INVENTION

By the present invention is provided a ski pole handle appearing from the succeeding claim 1.

By the fact that the element is situated on a control knob the clamping of the strap and release thereof for adjustment of the effective length of the strap can be performed by pushing down and raising of the control knob, respectively, which means ease of operation.

The clamping element may comprise a block or wedge integral with the knob, directed downwardly in the cavity, which has a portion tapering downwardly. Additionally to the block or wedge the knob may comprise arms, one at each side of the wedge, which may have clamping borders or edges facing each other, whereby the two strap portions are clamped between a respective arm and one side of the block or wedge when the knob is pushed down relatively to the handle. The block or wedge may, whether it is used alone or together with said arms, also have external clamping borders or edges, in order to improve the clamping of the strap.

The knob may constitute a natural extension of the handle, and in order to guide the knob and to keep it positioned when being in the raised position, i.e. whereby no clamping occurs, the knob and the handle have members which mutually mesh, but which enable the necessary pushing down and raising of the knob relatively to the handle. These members may for instance be a vertical, elongated recess in a wall of the knob, possibly at two or more locations, and a cooperating protrusion, for instance a short pin, possibly at two or more locations corresponding to the recesses in the handle, whereby the protrusion or protrusions is/are inserted in the recess or recesses in the wall of the knob. The recess or recesses may have an irregular width, with one or more constrictions, whereby the constriction or constrictions must pass the pin or pins during movement of the knob relatively to the handle. A premise for this is that the knob is of a material which may be deformed elastically. Thereby, the knob has two or more well defined positions, determined by the number of constrictions (one constrictions means two defined positions, two constrictions mean three defined positions, etc.) The constriction or constrictions will prevent unintentional raising of the knob, by creating a resistance against the movement. The reason why it may be desirable that the knob has more than two defined positions is that straps having different thicknesses, and which require different degrees of clamping in order to be fastened, can be used together with the same type of handle. The degree of clamping will depend on how far down the knob is pushed relatively to the handle.

The operation of the handle is simplified relatively to embodiments having a separate wedge or hinged member for clamping of the strap. The knob is to be operated by being pushed down and raised relatively to the remainder of the handle, for clamping and for releasing of the clamping, respectively. In order to indicate that the knob constitutes a control member it may be made in another colour than the handle, and the directions of movement may be shown by arrows on the knob. Because the knob is locked against loosening from the handle it cannot be lost.

BRIEF EXPLANATION OF THE DRAWINGS

The invention will in the following be explained more detailed, with reference to the accompanying drawings, showing a non-limiting example of an embodiment of a ski pole handle according to the invention.

The same reference numerals are used for the same parts in all of the Figures.

DESCRIPTION OF AN EXAMPLE OF AN EMBODIMENT

Figure 1:
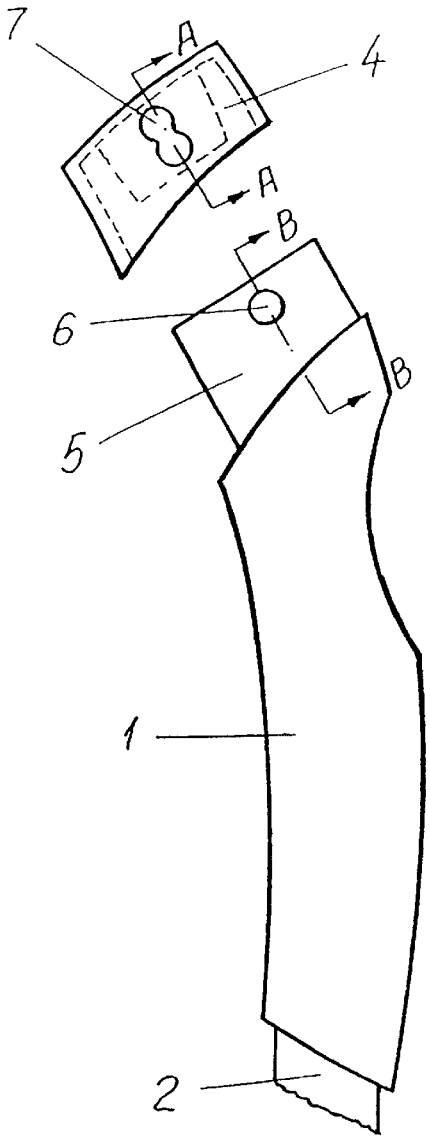
FIG. 1 shows a handle fastened to the upper end of a ski pole, with a knob shown detached from the handle.
Figure 2:
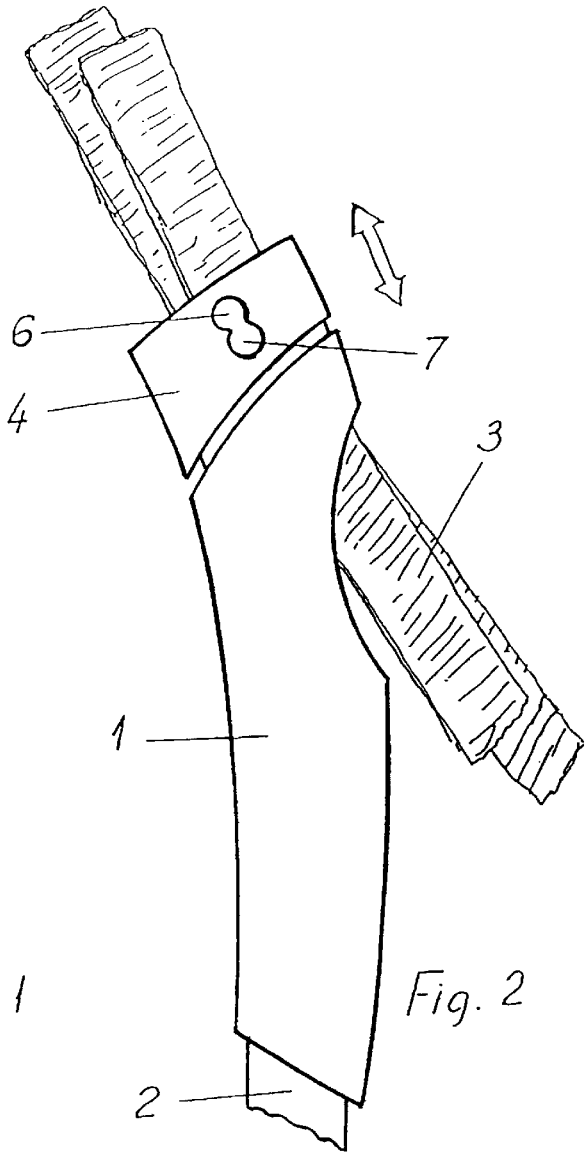
FIG. 2 shows the handle correspondingly as in FIG. 1, with the knob mounted on the handle and with a strap fastened to the handle.

FIGS. 1 and 2 show a handle 1 fastened to a ski pole 2, of which merely a small portion is shown. The handle 1 may for instance be inserted on the end of the ski pole 2 and be glued thereto. At the top the handle is somewhat narrowed, by having a peg shaped end 5. A knob 4, shown detached from the handle 1 in FIG. 1, can be mounted on the handle 1, as shown in FIG. 2, said knob being hollow and having a circumferential wall 11 (FIG. 4) matched to the external of the end 5 of the handle 1. In a mounted condition the knob 4 constitutes a natural extension of the handle 1, as it appears from FIG. 2.

Figure 4:
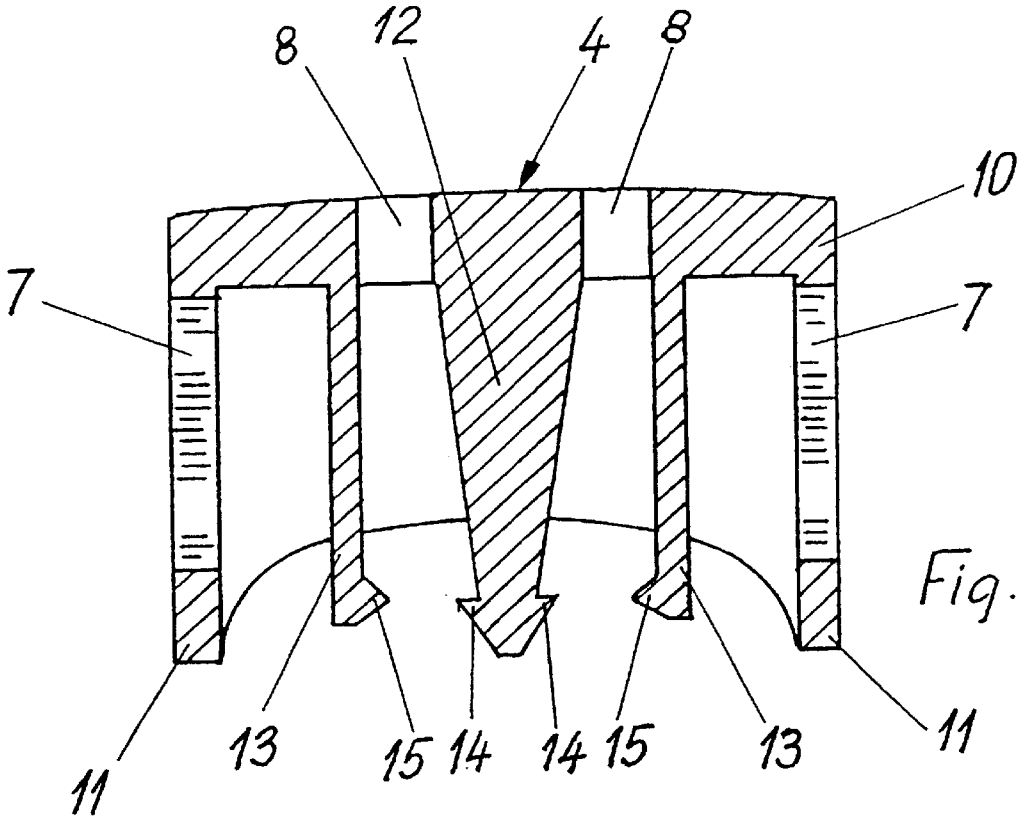
FIG. 4 shows a section A—A in FIG. 1.
Figure 5:
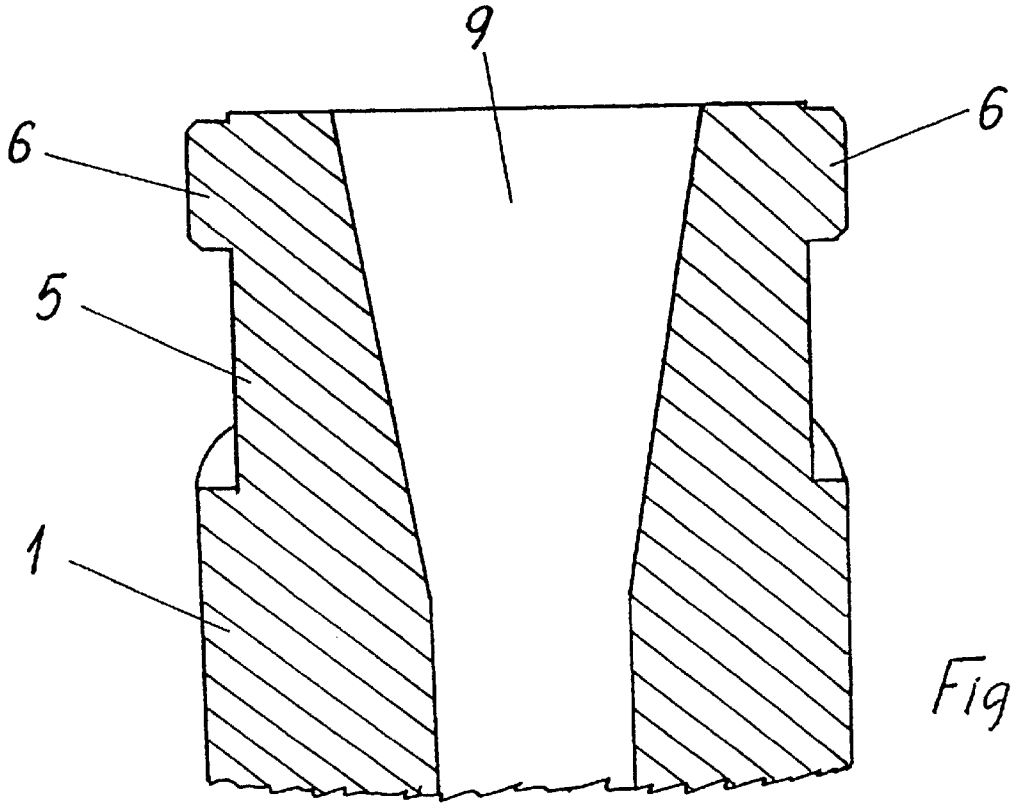
FIG. 5 shows a section B—B in FIG. 1.
Figure 6:
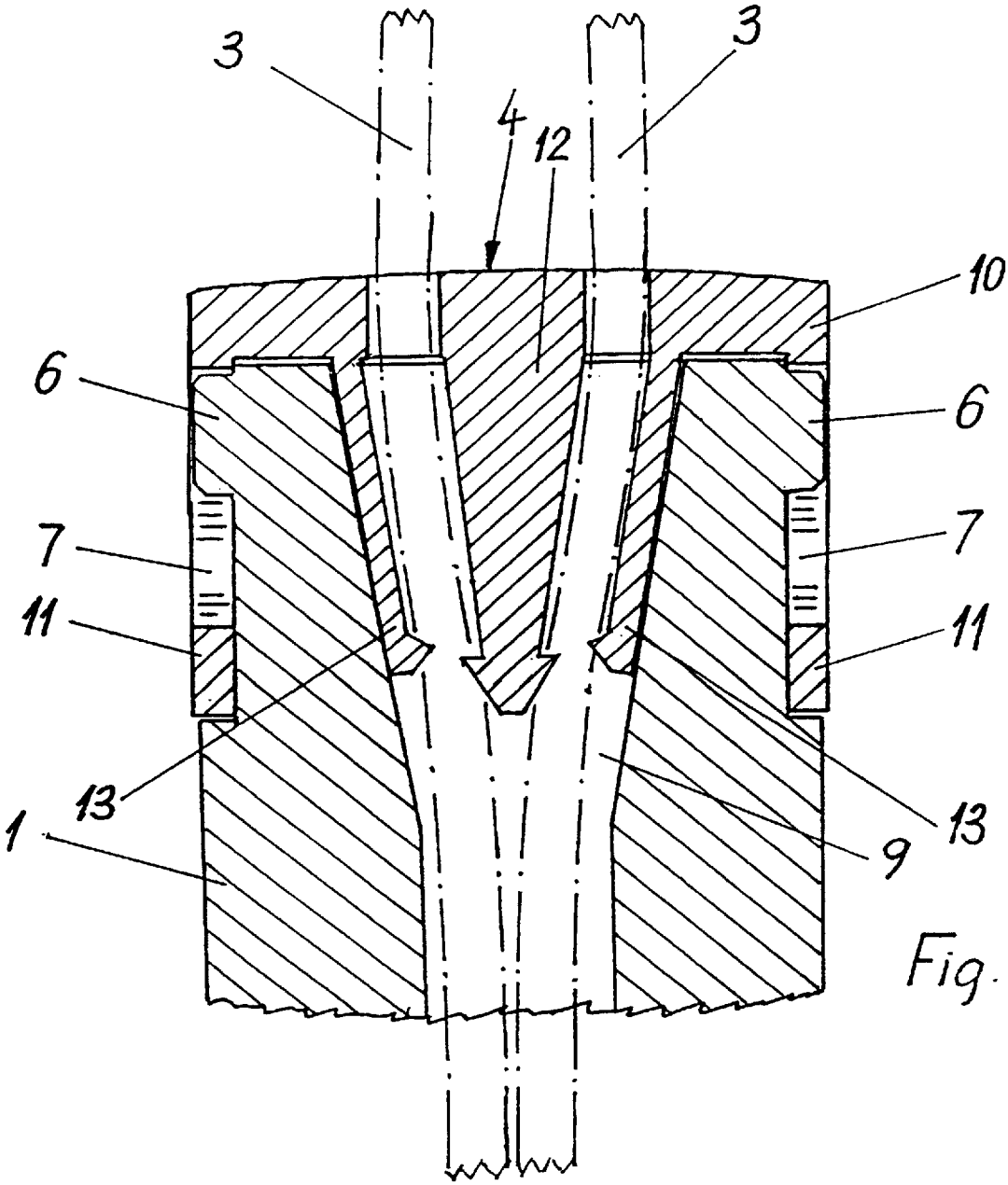
FIG. 6 shows, in a section corresponding to those of FIGS. 4 and 5, how two strap ends are clamped inside of the handle.

In order to lock the knob 4 in its mounted position on the handle 1 and simultaneously to permit a certain movement of the knob 4 relatively to the handle 1, the end 5 of the handle has two short pins protruding from opposite sides. FIGS. 1 and 2 show a pin 6 on one side of the end 5, while FIGS. 5 and 6 show both of the pins 6, in section. In the knob 4 are formed two recesses 7, extending through the wall 11 (FIG. 4). The recesses have such a location that the pins 6 can be inserted into the recesses 7 when the knob 4 is being mounted on the handle 1. Mounting requires elastic deformation of the knob 4, whereby the lower portion of each side of the wall 11 can pass the pins 6. By elastic back-deformation of the wall 11 the knob 4 is locked against being removed from the end 5 of the handle 1.

Because the recesses 7 have an elongated shape, the knob 4 can to some degree be moved relatively to the end 5. The distance of movement is determined by the excessive length of the recesses relatively to the diameter of the pins 6. In the embodiment shown the recesses 7 only have one constriction. As explained, the recesses may have plural constrictions. As appearing from FIG. 1, the recesses 7 have in the embodiment shown such a shape that they are constricted at their middle, whereby the constrictions must pass the pins 6 for movement of the knob 4 between the end positions. Thereby is achieved that the knob 4, due to the constrictions in the recesses 7, has defined end positions. By shaping the recesses 7 with more than one constriction the knob will additionally have one or more defined positions between the end positions.

FIG. 2 shows a strap 3 threaded through the handle 1 and the knob 4. The strap is shown cut off, and runs virtually in a loop downwardly.

Figure 3:
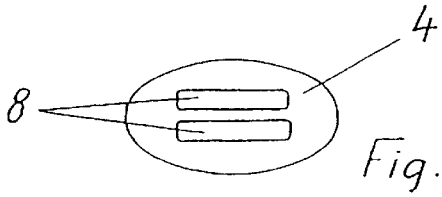
FIG. 3 shows the knob seen perpendicularly to its upper surface.

FIG. 3 shows the knob 4 seen perpendicularly to its upper surface. The knob 4 has two elongated apertures 8, for threading the free ends of the strap 3 therethrough .

FIGS. 4 and 5 show in section how the knob 4 and the upper end of the handle 1 may be shaped. FIG. 6 shows in a corresponding section the knob 4, when mounted on the handle 1 and when the ends of a strap 3 (shown by a dot-and-dash line) are clamped inside the handle 1 in that the knob 4 has been pushed down relatively to the handle 1. As shown in FIGS. 4 and 5, the knob 4 comprises an upper wall 10 with the two apertures 8 shown in FIG. 3. Moreover, the knob 4 comprises a wall 11, in which the recesses 7 are formed.

At the middle of the upper wall 10 the knob has an inner wedge 12, which on its free end may have protrusions 14 having more or less sharp edges. In the embodiment shown the knob 4 additionally has two arms 13, one on each side of the wedge 12, and the arms are also shown with edges 15 facing the wedge 12.

As will be understood, the knob 4 can be mounted on the narrowed end 5 of the handle 1 by deforming the wall 11 of the knob 4 elastically in order to pass the pins 6, whereupon elastic back-deformation of the wall 11 causes that the recesses 7 surround a respective pin 6. Thereupon, the knob 4 can only be moved longitudinally of the handle 1, a distance corresponding to the free space in the recesses 7, i. e. the length of the recesses 7 less the diameter of the pins 6 when these are cylindrical. It will be appreciated that the pins 6 may have other shapes than cylindrical, such as parallel-epipedical.

When the knob 4 is in its upper position on the handle 1, the arms 13 will due to their elasticity engage the wall of the inner cavity 9 in the handle, in a position higher than shown in FIG. 6, and the wedge 12 will be situated in a correspondingly high position, because both the arms 13 and the wedge 12 are integral with the upper wall 10 of the knob 4. Thereby, two strap ends 3 can be threaded through a lateral opening in the handle, from below and up through the cavity 9 in the handle 1, and further up through the knob 4. The strap ends 3 may be threaded through the handle 1 and the knob 4 prior to mounting of the knob 4 on the handle 1, whereby the strap ends 3 can easier be guided in order to enter the apertures 8 in the knob 4.

Prior to pushing the knob 4 entirely down on the handle 1 the strap ends 3 are positioned such that the strap forms a suitable loop downwardly from the handle 1, whereupon the knob 4 is pushed down to the position shown in FIGS. 2 and 6. Thereby, the arms 13 are deformed against the wedge 12 due to the downwardly tapering cavity 9 in the handle 1, whereby the edges 15 on the arms 13 are pressed against the strap ends 3 and press the strap ends 3 against the edges 14 on the wedge 12. Thereby, the strap ends 3 are clamped inside the handle 1.

In order to adjust the size of the strap loop the knob 4, constituting an upward extension of the handle 1, is seized and is pulled upwardly as far as determined by the recesses 7 and the pins 6, and the clamping of the strap ends 3 is released, whereby the user can pull the strap ends 3 extending upwardly from the knob 4 or the strap protruding from the handle 1 further down, in order to adjust the strap to a suitable size for the loop, whereupon the knob 4 is pushed down and locks the strap in the position chosen.

The shown arms 13 may be omitted, whereby the strap is pressed directly against the wall in the cavity 9 by the wedge 12. However, the omission of the arms 13 will lead to a more unsafe fastening of the strap. In particular when the handle is to be used with straps having different thicknesses the arms 13 will ensure that a secure clamping is achieved in any case. The wedge 12 may be replaced by another element, such as a parallelepipedical block, which by being pushed down as a part of the knob 4 will clamp the strap in the cavity 9.

The cavity 9 is said to be situated in the handle. There is, however, no hindrance to the handle being a composite element, whereby the cavity is situated in an upper handle element, while the remainder of the handle constitutes another element to which the upper element is attached. As an example the upper element of the handle may be of plastics, while the other element of the handle may be a plastic sleeve having an external liner, for instance of skin, leather or cork. Alternatively, for instance the upper element of the handle and the sleeve may be integral, with a liner provided externally on the sleeve.

What is claimed is:

1. A ski pole handle arranged to permit adjustment of the effective length of a strap fastened to the handle, said handle having in its upper portion a throughgoing cavity through which the strap is threaded, and an element is adapted to be pressed down into the cavity in order to clamp the strap against walls of a downwardly tapering portion of the cavity, the element situated on a control knob mounted at the top of the handle and arranged to be pushed down and raised relative to the handle, for fastening and releasing the strap, respectively, said knob having at least one throughgoing aperture for the strap and a circumferential wall surrounding the upper end of the handle, wherein cooperating members in the circumferential wall and on the end of the handle permit limited longitudinal movement of the knob relative to the handle.

2. A ski pole handle according to claim 1, wherein the element is a block.

3. A ski pole handle according to claim 2, wherein the knob comprises an arm on each side of the block, said arms having clamping borders or edges facing the block.

4. A ski pole handle according to claim 2, wherein the block has external clamping borders or edges.

5. A ski pole handle according to claim 1, wherein the element is a wedge.

6. A ski pole handle according to claim 1, wherein the circumferential wall has at least one recess and the end of the handle has a corresponding number of protrusions engaging the recesses and limiting the movement of the knob.

7. A ski pole handle according to claim 6, wherein the at least one recess has at least one constriction between the ends, thereof such that the at least one constriction has to pass the protrusion or protrusions by movement of the knob, the knob having at least two defined positions.

8. A ski pole handle according to claim 7, wherein the at least one recess has more than one constriction, the knob having at least three defined positions.

* * * * *